US006032812A

United States Patent [19]

Lamoureux

[11] Patent Number: 6,032,812

[45] Date of Patent: Mar. 7, 2000

[54] ONE-PIECE CAP FOR LIQUID DISPENSER CONTAINER

[75] Inventor: Richard Lamoureux, Quëbec, Canada

[73] Assignee: Crealise Packaging Inc., Quebec, Canada

[21] Appl. No.: 09/230,176

[22] PCT Filed: Jun. 5, 1997

[86] PCT No.: PCT/CA97/00392

§ 371 Date: Jan. 21, 1999

§ 102(e) Date: Jan. 21, 1999

[87] PCT Pub. No.: WO98/03426

PCT Pub. Date: Jan. 29, 1998

[30] Foreign Application Priority Data

Jul. 22, 1996 [CA] Canada ..... 2181828

[51] Int. Cl.[7] ..... B65D 51/00

[52] U.S. Cl. ..... 215/303; 215/253; 215/254; 220/229; 141/351; 141/364

[58] Field of Search ..... 215/253, 254, 215/256, 250, 295, 296, 297, 301, 302, 303; 220/229, 265, 266; 141/351–354, 364

[56] References Cited

U.S. PATENT DOCUMENTS

| | | | |
|---|---|---|---|
| 584,091 | 6/1897 | Leidich | 220/229 |
| 1,142,210 | 6/1915 | Wagner . | |
| 1,248,705 | 12/1917 | Pogue . | |
| 2,213,465 | 9/1940 | Gay . | |
| 3,392,860 | 7/1968 | Faulstich . | |
| 3,874,554 | 4/1975 | Chang | 220/229 |
| 3,899,100 | 8/1975 | Rigaud | 220/229 |
| 3,938,520 | 2/1976 | Scislowicz et al. . | |
| 3,979,002 | 9/1976 | Faulstich . | |
| 4,022,258 | 5/1977 | Steidley . | |
| 4,053,084 | 10/1977 | Anderson | 220/229 |
| 4,093,096 | 6/1978 | Augros . | |
| 4,173,858 | 11/1979 | Cassia . | |
| 4,243,150 | 1/1981 | Gunne et al. . | |

(List continued on next page.)

FOREIGN PATENT DOCUMENTS

| | | |
|---|---|---|
| 0 118 267 | 9/1984 | European Pat. Off. . |
| 448753 | 5/1949 | Italy . |
| 1104638 | 2/1968 | United Kingdom . |
| WO 93/07084 | 4/1993 | WIPO . |

*Primary Examiner*—Nathan J. Newhouse
*Attorney, Agent, or Firm*—Finnegan, Henderson, Farabow, Garrett & Dunner, L.L.P.

[57] ABSTRACT

A one-piece cap (10) for closing a liquid container to be installed for supply purpose in upside down position onto a liquid dispenser. Such container has a neck (14) on which the cap is sealingly mounted and through which a liquid supply tube (70) passes when the container is installed onto the dispenser. The cap comprises a lid (30) having a surface area substantially identical to the one of the neck (14), and a skirt (50) integrally projecting from the lid. The lid is provided with a central recess (32) including a tubular guiding portion (34) projecting from the lid in the same direction as the skirt (50). The guiding portion is sized and positioned to receive the supply tube (70). The central recess also includes a bottom portion that is in the form of a cone (36) that projects from the guiding portion and is provided with a number of frangible lines (38) extending within meridian planes in such a manner so as to allow splitting of the cone into a corresponding number of petal-shaped segments when the container is installed onto the dispenser and its cap and neck are penetrated by the supply tube. This cap is useful in that it may be used in any kind of water dispenser.

10 Claims, 4 Drawing Sheets

U.S. PATENT DOCUMENTS 4,354,609 10/1982 Hidding .
4,364,483 12/1982 Golde .
4,393,909 7/1983 Pearson .
4,460,100 7/1984 Libit .
4,461,394 7/1984 Sendel et al. .
4,527,704 7/1985 Swartzbaugh .
4,527,706 7/1985 Swartzbaugh et al. .
4,658,977 4/1987 Crisci .
4,699,188 10/1987 Baker et al. .
4,736,859 4/1988 Mayes et al. .
4,846,236 7/1989 Deruntz .
4,874,023 10/1989 Ulm .
4,946,055 8/1990 Towns et al. .
4,948,003 8/1990 Munoz .
4,948,009 8/1990 Sawatani .
4,991,635 2/1991 Ulm .
5,123,555 6/1992 Luch et al. .
5,188,628 2/1993 Rani et al. .
5,202,093 4/1993 Cloyd .
5,203,838 4/1993 Schneider .
5,222,530 6/1993 Baker et al. .
5,232,125 8/1993 Adams .
5,273,083 12/1993 Burrows .
5,284,188 2/1994 Baker et al. .
5,297,599 3/1994 Bucheli .
5,370,270 12/1994 Adams et al. .
5,392,939 2/1995 Hidding et al. .
5,397,023 3/1995 Toczek et al. .
5,413,152 5/1995 Burrows .
5,464,127 11/1995 Burrows .
5,513,763 5/1996 Adams et al. .
5,687,865 11/1997 Adams et al. .
5,687,867 11/1997 Lamoureux ..... 215/253 X
5,937,921 8/1999 Guglielmini ..... 215/303 X FIG. 5
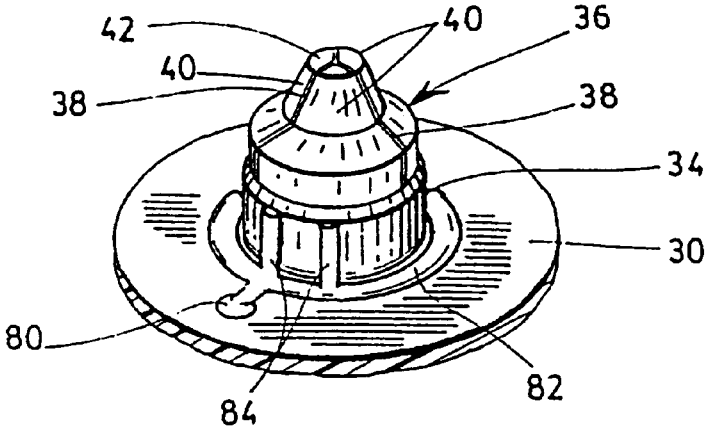
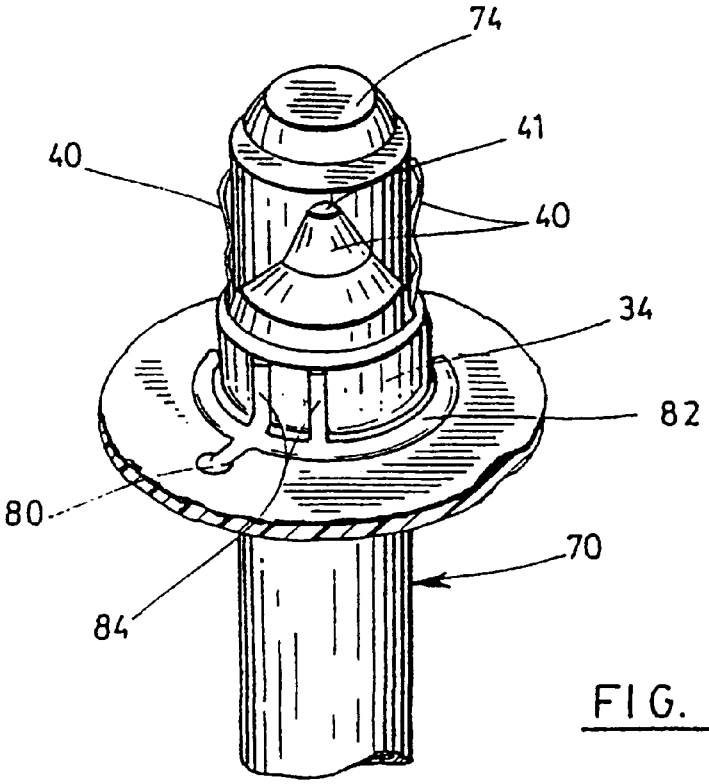
FIG. 6

ONE-PIECE CAP FOR LIQUID DISPENSER CONTAINER

FIELD OF THE INVENTION

The present invention relates to a one-piece cap for closing a liquid container of the type to be installed for supply purpose in upside down position onto a liquid dispenser. More particularly, it relates to a cap for use to seal the neck of a water bottle used as a water source on a standard water dispenser or water cooler.

BACKGROUND OF THE INVENTION

Water dispensers or water coolers are well known devices that are used as a clean and safe source of drinkable water. Such devices usually comprise a housing including an internal water reservoir operatively connected to an external dispensing faucet. A supporting platform provided with a central opening extends on top of the water reservoir. This platform is devised to receive and support a water bottle in an inverted position, with the neck of the bottle neck projecting downwardly through the central opening into a dispenser insert in liquid communication with the underlying reservoir so as to allow water to flow down by gravity into the reservoir and refill the same as soon as the faucet is operated.

In order to avoid spilling of water during loading onto the dispenser of a water which may usually have a volume of 5-gallons (18 liters), it has been of common practice for a long time to close the neck of the water bottle with a cap having a central recess provided with a flat bottom intended to be pierced by a hollow spike projecting centrally and upwardly within the dispenser insert. With such a hollow spike in which the water may flow down from the water bottle into the water reservoir, it is no more necessary to remove the cap before installation of the bottle, thereby making such installation much easier and cleaner. Examples of caps of this type are disclosed in the following patents:

U.S. Pat. No. 4,699,188 (Baker et al)

U.S. Pat. No. 4,846,236 (Deruntz)

U.S. Pat. No. 5,123,555 (Luch et al)

More recently, it has been suggested that, instead of using a perforating spike, use be made of a supply tube having a smooth tip sized and shaped to engage the central recess of the cap and cause the bottom of the same, which is formed as a plug, not only to be pushed, removed or torn out but also to snap onto the tip of the tube and thus be retained by the same.

According to a first variant, the plug is separate from the cap and devised to be slid by the tube within the central recess in order to free openings allowing water to flow down. See, by way of examples, the following patents:

U.S. Pat. No. 4,874,023 (Ulm)

U.S. Pat. No. 4,991,635 (Ulm)

According to a second variant, the plug is devised to be removed from the central recess and the smooth tip of the tube is provided with a circular recess on which the plug may snap as soon as it leaves the recess. See, by way of examples, the inventions disclosed in the following patents:

U.S. Pat. No. 5,370,270 (Adams et al)

U.S. Pat. No. 5,392,939 (Hidding)

According to a third variant, the plug forms an integral part of the central recess. In use, it is torn out from the recess by the pressure applied by the tube, once the bottle is positioned on it. To facilitate such tearing, a circular frangible line is provided on the periphery of the bottom of the recess. An inwardly projecting bead is also provided on the plug to caused the same snap in a corresponding groove provided on the tip of the tube. See, by way of example, the invention disclosed in the following patents:

U.S. Pat. No. 5,222,530 (Baker et al)

U.S. Pat. No. 5,273,083 (Burrows)

U.S. Pat. No. 5,284,188 (Baker et al)

U.S. Pat. No. 5,413,152 (Burrows)

U.S. Pat. No. 5,464,127 (Burrows)

As it can be understood, snapping of the plug onto the supply tube is interesting in that it prevents the plug from floating at the surface of the water bottle and thus be visible to by potential users, as the bottles are usually-made from transparent plastic material.

As aforesaid, the water dispensers that are presently used, are of two kinds, each associated with a type of cap. The problem is that water dispensers provided with a spike cannot be used efficiently with water bottles having a cap with a plug. Similarly, water dispensers having a supply tube with a smooth tip cannot be used efficiently with bottles having a cap with a central recess whose flat bottom is intended to be pierced. Therefore, even if the prior art devices are useful in some ways, there is a need of a cap for closing a water dispenser bottle or container, which would be easy to manufacture and versatile enough to be used on any one of the above mentioned kinds of water dispensers.

SUMMARY OF THE INVENTION

The object of the invention to provide a one-piece cap for closing a liquid container (or "bottle") of the type intended to be installed for supply purpose in upside down position onto any kind of liquid dispenser, such container having a neck on which the cap is sealingly mounted and through which a liquid supply tube passes when the container is installed onto the dispenser.

This cap comprises a lid having a surface area substantially identical to the one of the neck. It also comprises a skirt integrally projecting from the lid portion. The skirt has an internal face on which gripping means are provided for sealing the liquid container neck. The lid is provided with a central recess including a tubular guiding portion projecting from the lid in the same direction as the skirt. This guiding portion is sized and positioned to receive the supply tube. The central recess of the lid also includes a bottom portion.

In accordance with the invention, this one-piece cap of conventional structure is improved in that the bottom portion of its central recess is in the form of a cone that projects away from the guiding portion and which is provided with a number of frangible lines extending within meridian planes in such a manner so as to allow splitting of the cone into a corresponding number of petal-shaped segments each provided with a tip when the container is installed onto the dispenser and its cap and neck are penetrated by the supply tube.

Advantageously, the cap is made of a plastic material and the cone has a thickness smaller than the average thickness of the guiding portion and lid.

The cone forming the bottom portion of the cap preferably comprises three equally spaced apart frangible lines. However, it may comprise more than three frangible lines, if desired. Preferably also, the cone has a truncated top and a peripheral surface forming an annular, outwardly projecting step of V-shaped cross-section that is adjacent to the guiding portion and defines an annular inner flange. When the cone is splitted, this flange comes into contact with the supply tube and causes the tips of the segments to extend at a short distance away from the tube, thereby preventing any interference with the same during removal of the bottle.

The apex of the cone may range from 30 to 120°. More preferably, this apex is equal to about 60°.

The cap may also comprise an integral pull tab located adjacent to another frangible line extending across part of the skirt portion in order to allow easy removal of the cap from the neck of the container after use.

The cap according to the invention can be used in any kind of liquid dispenser or liquid cooler, whatever be the shape of their liquid supply tubes. This cap is not only efficient but also inexpensive to fabricate.

Other objects, features and advantages of the present invention will be apparent from the following non-restrictive description of a preferred embodiment of the invention, made with reference to the accompanying drawings.

BRIEF DESCRIPTION OF THE DRAWINGS

FIG. 5 is a fragmentary perspective view of the central recess of the cap shown in FIG. 1;

FIG. 6 is a fragmentary perspective view similar to the one of FIG. 5, showing the supply tube fully engaged through the central recess of the cap, as is shown in side elevation in FIG. 4.

DESCRIPTION OF A PREFERRED EMBODIMENT OF THE INVENTION

Figure 2:
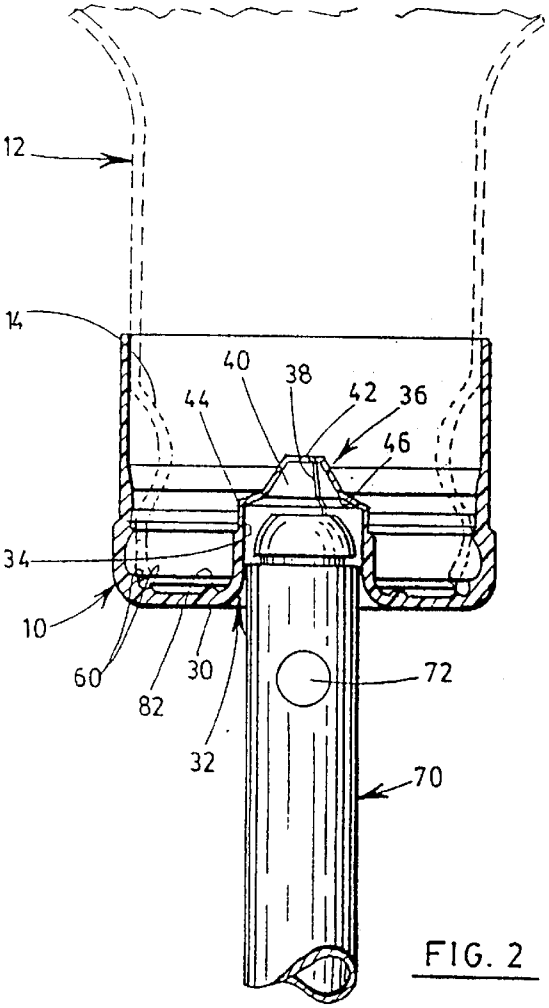
FIG. 2 is a view similar to the one of FIG. 1, showing the supply tube engaged within the guiding portion of the central recess of the cap.

FIGS. 1 to 4 show the successive relative positions of the supply tube 70 of a liquid dispenser and the neck 14 of a liquid container 12 closed with a one-piece cap 10 according to the invention, while the container is installed in upside down position onto the dispenser.

The liquid container 12 is preferably a standard commercial water bottle.

The cap 10 which is sealingly mounted onto the neck 14 of the bottle comprises a lid 30 having a surface area substantially identical to the one of the neck 14. The cap also comprises a skirt 50 integrally projecting from the lid portion 30. The skirt 50 has an internal face on which gripping means are provided. These gripping means preferably comprise a tension ring 58 sized to fit within a recess 16 made in the bottle neck 14, and an upper seal bead 60 which tightly engage the container neck and seal it against leakage.

The cap 10 preferably comprises also an integral pull tab 54 located adjacent to another frangible line 56 across part of the skirt 50 in order to allow easy removal of the cap 10 from the neck 14 of the container 12 after use, by pulling the tab 54.

The lid 30 is provided with a central recess 32 through which the liquid supply tube 70 passes when the container 12 is installed onto the dispenser. This central recess includes a tubular guiding portion 34 projecting from the lid 30 in the same direction as the skirt 50. The guiding portion 34 is sized and positioned to receive the supply tube 70. The size of this guiding portion must be sufficient to firmly maintain the supply tube 70 while not being subject to easy breakage. This size must also be sufficient to avoid water leak between the supply tube 70 and the tubular guiding portion 34 when the supply tube is splitting the cone-shaped bottom portion of the cap during the installation of the container onto a dispenser or cooler device as will be better described hereinafter (see FIG. 3). If desired, a circular sealing bead (not shown) may be formed onto the inner wall of the guiding portion 34 so as to contact the periphery of the supply tube 20 and prevent water leaks.

The supply tube 70 shown on FIGS. 1 to 4 and 6 is an hollowed tube provided with a rounded tip or head 74 and with at least one hole 72 allowing water to flow down through the supply tube 70 into the reservoir of the dispenser. However, other types of supply tubes could be used similarly, like, for example, a spike.

As is better shown in FIG. 5, the central recess 32 also includes a bottom portion 36 which, in accordance with the invention, is in the form of a cone that projects from the guiding portion 34. This cone has an apex a which may range from 30 to 120° and is preferably equal to 60° as is shown (see FIG. 1). The cone 36 is provided with a number of frangible lines 38 extending within meridian planes in such a manner so as to allow splitting of the cone into a corresponding number of petal-shaped segments 40 each with a top 41 when the container 12 is installed onto the dispenser and its cap 10 and neck 14 are penetrated by the supply tube 70. Advantageously, as shown in FIGS. 5 and 6, the frangible lines 38 are equally spaced apart and are preferably three in number. However, a number of more than three equally spaced frangible lines 38 could also be used if wanted.

Figure 4:
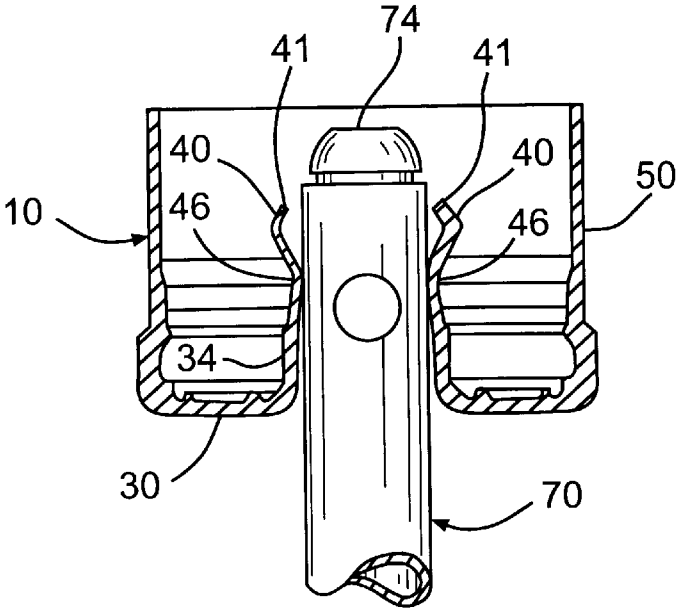
FIG. 4 is a view similar to the one of FIG. 1, showing the supply tube fully engaged within the bottle neck.
Figure 3:
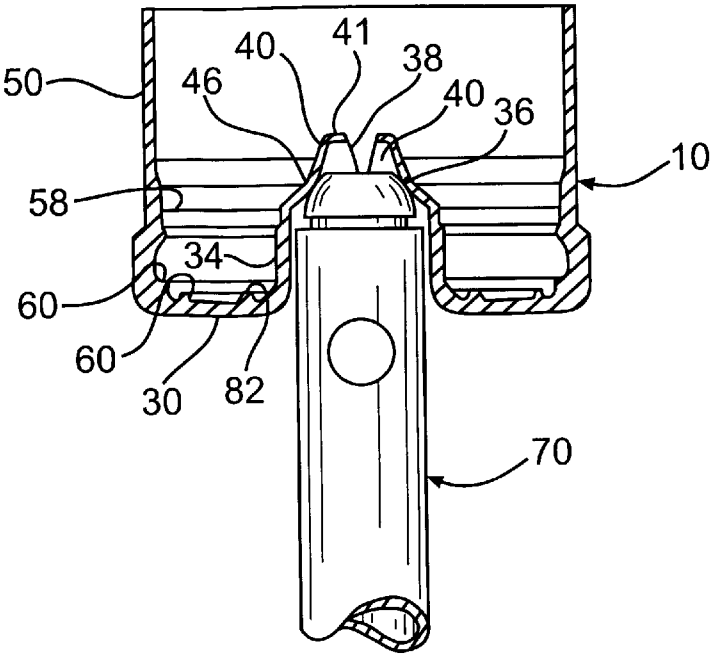
FIG. 3 is a view similar to the one of FIG. 1, showing the supply tube splitting the cone-shaped bottom portion of cap.

In accordance with a preferred embodiment of the invention, the cone 36 has a truncated top 42 and a peripheral surface forming an annular, outwardly projecting step 44 of V-shaped cross-section that is adjacent to the guiding portion 34 and defines an annular inner flange (46) at a given distance from the top 42. In use, when the cone is splitted, the flange 46 comes into contact with the supply tube 70 and causes the tips 41 of the segments to extend at a short distance away from the tube 70 as is shown in FIG. 4.

Figure 1:
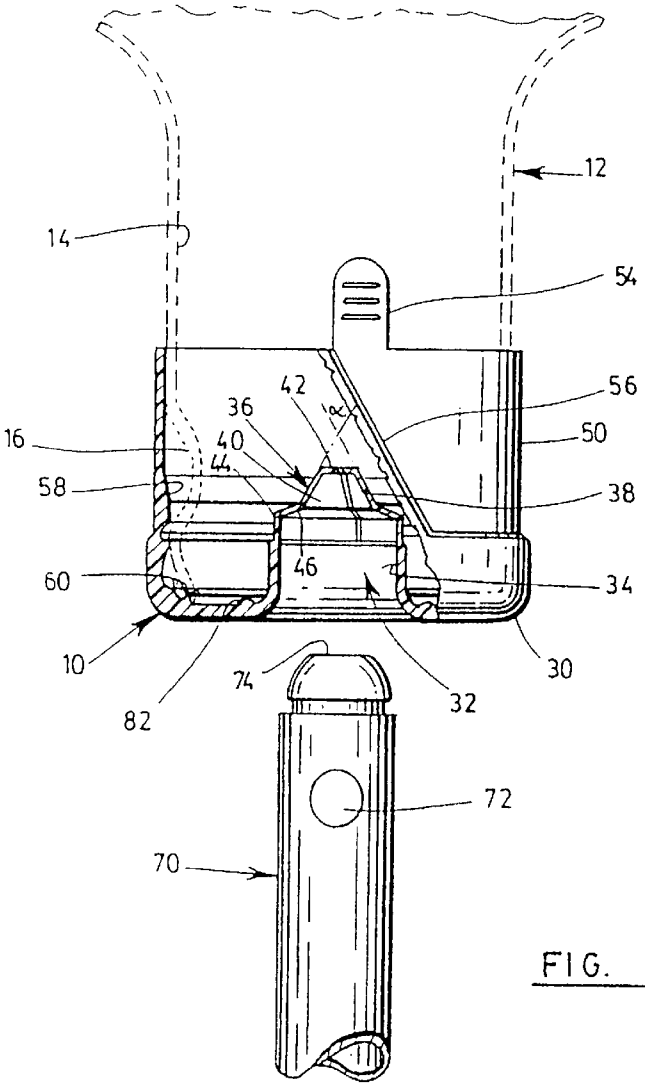
FIG. 1 is a side elevational view, partly in cross-section, showing the neck of a water container provided with a cap according to the invention, prior to its penetration by the water supply tube of a water dispenser or water cooler device.

During installation on a dispenser or cooler device, the container 12 is held in upside down position and the central recess 32 of the cap 10 is positioned in regard to the supply tube 70, as shown in FIG. 1. The liquid container 12 is then lowered onto the dispenser. During such lowering, the supply tube 70 engages the tubular guiding portion 34 of the central recess 32 and contacts the bottom portion 36 thereof as shown in FIG. 2. Further lowering of the liquid container 12 to the position of FIG. 3 causes a breakage of the frangible lines 38 and a splitting of the cone into a plurality petal-shaped segments 40. Thanks to the shape of the bottom portion and the position of the frangible lines onto the same, the requested breakage is easily achieved even when the supply tube has a smooth tip. As the liquid container 12 is further lowered, as shown in FIG. 4, the hole 72 of the tube comes into contact with the liquid which then may flow down through the supply tube 70 into the reservoir of the dispenser. After the liquid has been dispensed, the user may remove the container 12 from the dispenser by reversing the operations shown in FIGS. 1 to 4. Thanks to the step 44 and the flange 46 defined by the same, which comes into contact with the supply tube 70 and causes the tips 41 of the segments 40 to extend at a distance from the tube (see FIG. 4), there is no risk of interference and jamming of the segments 40 with the hole and or head of the tube during removal of the bottle. After removal, the tab 54 may be gripped to tear the skirt 50 along the frangible line 56. Such allows the cap 10 to be removed from the liquid container 12 which may be recycled.

The one-piece tab 10 can be made of plastic material by moulding. Preferably, the mould is devised so that the cone 36 is of a smaller thickness than the guiding portion 34 and the lid 30. This gives additional flexibility to the petal-shaped segments 40.

Figure 7:
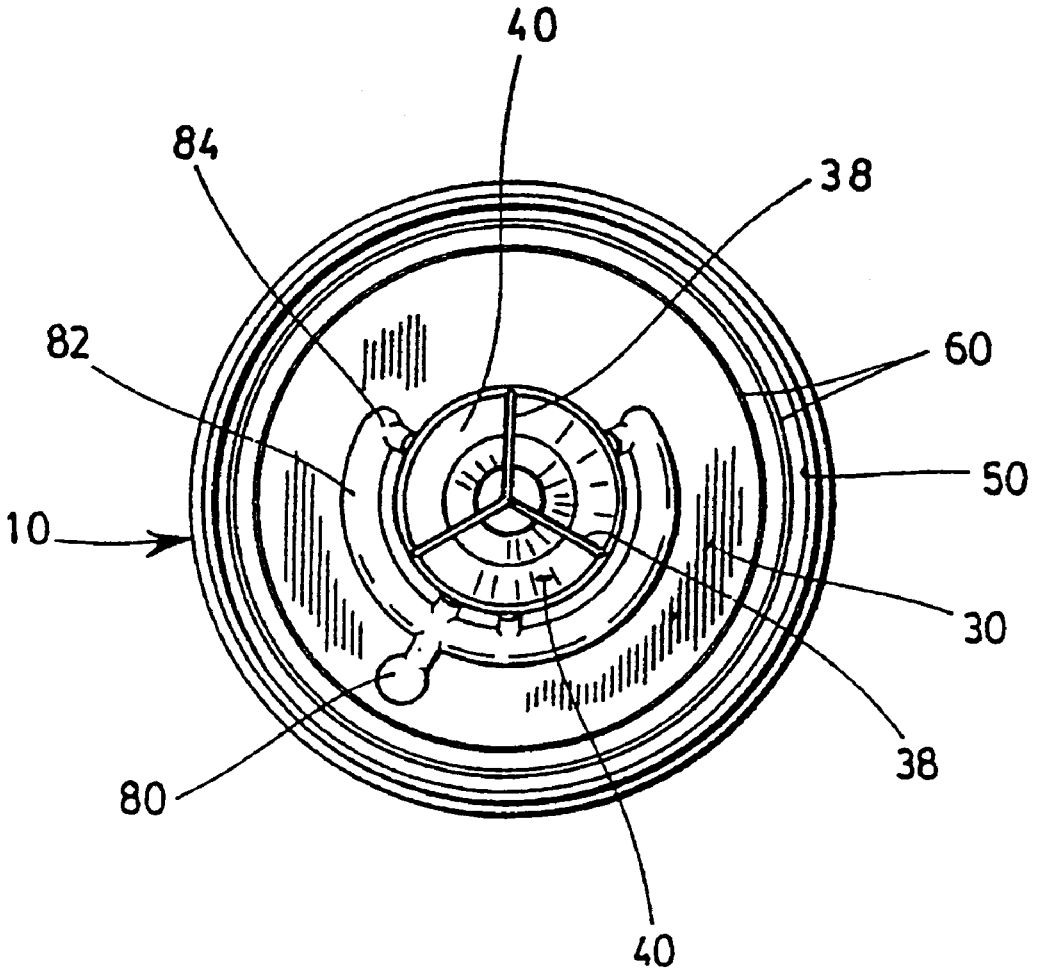
FIG. 7 is a bottom view of the cap shown in FIG. 1.

As is better shown in FIGS. 5 to 7, the moulding can be carried out by injecting the plastic material in the mould at an injection point 80 located in the lid portion of the mould. To make it sure that the cone portion of the mould be fully filled up eventhough it is of smaller thickness that the remaining portions of the same channels 82 and 84 can be provided in the lid and guiding portions of the mould to give full access to the plastic material injected through the point 80 to all the segments 40 of the cone. Once it is moulded, the cap can be mounted onto the neck 14 of a liquid container 12 by any known methods.

While only one preferred embodiment of this invention has been shown and described, it would be apparent to those skilled in the art that modifications are possible without departing from the scope of the invention as defined in the appended claims.

I claim:

1. A one piece cap for closing a liquid container of the type to be installed for a supply purpose in an upside down position onto a liquid dispenser, the container having a neck on which the cap sealingly mounts and through which a liquid supply tube passes when the container is installed onto the dispenser, said cap comprising:

a lid having a surface area substantially conforming to a surface area of the neck; and a skirt projecting from the lid;

said skirt having an internal face including gripping means for sealing the neck of the liquid container, said lid having a central recess including a tubular guiding portion projecting from the lid in a same direction as the skirt, said guiding portion being sized and positioned to receive the supply tube, said central recess also including a bottom portion in the form of a cone that projects away from the guiding portion, said cone being provided with a number of frangible lines extending within meridian planes in such a manner so as to allow splitting of said cone into a corresponding number of petal-shaped segments each having a tip when the container is installed onto the dispenser and its cap and neck are penetrated by the supply tube, said cone also having a truncated top and a peripheral surface forming an annular, outwardly projecting step of a generally V-shaped cross-section that is adjacent to said guiding portion and defines an annular inner flange at a distance from said top, whereby, in use, when the cone is split, said flange comes into contact with the supply tube and causes the tips of said segments to extend at a short distance away from the tube.

2. The cap of claim 1, wherein the cap further comprises an integral pull tab located adjacent to another frangible line extending across a part of said skirt in order to allow easy removal of the cap from the neck of the container after use.

3. The cap of claim 1 or 2, wherein the cap is made of plastic material.

4. The cap of claim 1 or 2, wherein said cone forming the bottom portion of the recess comprises three equally spaced frangible lines.

5. The cap of claim 4, wherein said cone has an apex of 30 to 120°.

6. The cap of claim 4, wherein the cap is made of plastic material.

7. The cap of claim 1 or 2, wherein said cone has an apex of 30 to 120°.

8. The cap of claim 7, wherein the cap is made of plastic material.

9. The cap of claim 7, wherein the apex of said cone is 60°.

10. The cap of claim 9, wherein the cap is made of plastic material.

* * * * *